US011649725B2

(12) United States Patent
Pelletier et al.

(10) Patent No.: US 11,649,725 B2
(45) Date of Patent: May 16, 2023

(54) DOWNHOLE TOOL WITH FILTRATION DEVICE

(71) Applicant: HALLIBURTON ENERGY SERVICES, INC., Houston, TX (US)

(72) Inventors: Michael T. Pelletier, Houston, TX (US); Christopher Michael Jones, Houston, TX (US); Darren Gascooke, Houston, TX (US); David L. Perkins, Easton, PA (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 1041 days.

(21) Appl. No.: 16/064,975

(22) PCT Filed: Dec. 28, 2016

(86) PCT No.: PCT/US2016/068984
§ 371 (c)(1),
(2) Date: Jun. 21, 2018

(87) PCT Pub. No.: WO2018/125100
PCT Pub. Date: Jul. 5, 2018

(65) Prior Publication Data

US 2021/0207478 A1 Jul. 8, 2021

(51) Int. Cl.
*E21B 49/08* (2006.01)
*E21B 49/10* (2006.01)
(Continued)

(52) U.S. Cl.
CPC ..... *E21B 49/08* (2013.01); *E21B 43/38* (2013.01); *E21B 47/06* (2013.01);
(Continued)

(58) Field of Classification Search
CPC .... E21B 49/081; E21B 49/08; E21B 49/0875; E21B 49/10; E21B 49/082; E21B 47/06; E21B 43/38
See application file for complete search history.

(56) References Cited

U.S. PATENT DOCUMENTS 4,994,671 A 2/1991 Safinya et al.
5,139,085 A * 8/1992 Duvallet ..... E21B 49/082 166/165
(Continued)

FOREIGN PATENT DOCUMENTS

EP 1986954 B1 11/2015
WO 2004081334 A2 9/2004
(Continued)

OTHER PUBLICATIONS

International Search Report and Written Opinion; PCT Application No. PCT/US2016/068984; dated Oct. 30, 2017.
(Continued)

*Primary Examiner* — Abby J Flynn
*Assistant Examiner* — Yanick A Akaragwe
(74) *Attorney, Agent, or Firm* — Novak Druce Carroll LLP

(57) ABSTRACT

Downhole tool is provided that includes a body, an intake port for receiving fluid from external the body, a pump, a filtration device, and an exit port. The pump is in fluid communication with the intake port for withdrawing fluid through the intake port. The filtration device has a particulate removing filter, and a flow line extending from the intake port to the filtration device. The filtration device is contained within the body and is in fluid communication with the intake port. The exit port is in fluid communication with the filtration device for ejecting the fluid to external the body.

20 Claims, 6 Drawing Sheets

(51) Int. Cl.
*E21B 43/38* (2006.01)
*E21B 47/06* (2012.01)

(52) U.S. Cl.
CPC ..... *E21B 49/0875* (2020.05); *E21B 49/10* (2013.01); *E21B 49/082* (2013.01)

(56) References Cited

U.S. PATENT DOCUMENTS

| | | | | |
|---|---|---|---|---|
| 8,408,298 | B2 | 4/2013 | Briquet et al. | |
| 8,770,286 | B2 | 7/2014 | Briquet et al. | |
| 2004/0104026 | A1* | 6/2004 | Johnson | E21B 43/08 166/227 |
| 2004/0233446 | A1 | 11/2004 | Dong et al. | |
| 2009/0007652 | A1* | 1/2009 | Childers | E21B 47/09 73/152.54 |
| 2009/0217776 | A1* | 9/2009 | Jamison | G01N 33/2823 73/863.23 |
| 2010/0126717 | A1 | 5/2010 | Kuchuk et al. | |
| 2010/0193187 | A1* | 8/2010 | Briquet | E21B 49/081 166/264 |
| 2010/0236776 | A1* | 9/2010 | Spross | E21B 49/08 166/250.02 |
| 2011/0284219 | A1 | 11/2011 | Pomerantz et al. | |
| 2012/0292024 | A1 | 11/2012 | Fox et al. | |
| 2013/0175036 | A1 | 7/2013 | Hausot | |
| 2013/0220595 | A1 | 8/2013 | Briquet et al. | |
| 2015/0068734 | A1* | 3/2015 | Smits | E21B 49/10 166/250.01 |
| 2018/0120865 | A1* | 5/2018 | Nuryaningsih | G01F 1/30 |

FOREIGN PATENT DOCUMENTS

| | | | |
|---|---|---|---|
| WO | 2010116228 | A2 | 10/2010 |
| WO | 2011073789 | A2 | 6/2011 |
| WO | 2013062879 | A1 | 5/2013 |
| WO | 2013177146 | A1 | 11/2013 |

OTHER PUBLICATIONS

Crombie, Alastair et al; "Innovations in Wireline Fluid Sampling", Oilfield Review; pp. 26-41; Autumn 1998.

Kuchuk, Fikri et al.; "Focus in on fluids", Middle East Reservoir Review; pp. 12-23; No. 2, 2001.

Search Report; French Application No. 1761281; dated Feb. 5, 2019.

* cited by examiner

DOWNHOLE TOOL WITH FILTRATION DEVICE

CROSS-REFERENCE TO RELATED APPLICATIONS

This application is a national stage entry of PCT/US2016/068984 filed Dec. 28, 2016, said application is expressly incorporated herein in its entirety.

FIELD

The present disclosure relates generally to filtration devices. In particular, the present disclosure relates to filtration devices for downhole tools.

BACKGROUND

Wellbores are drilled into the earth for a variety of purposes including tapping into hydrocarbon bearing formations to extract the hydrocarbons for use as fuel, lubricants, chemical production, and other purposes. The oil and gas industry typically conducts comprehensive evaluations of underground hydrocarbon reservoirs prior to wellbore development and production. Formation evaluation procedures may involve the collection of formation fluid samples for hydrocarbon content analysis. Accordingly, a variety of tools can be provided downhole for obtaining samples from a formation or other fluids in the wellbore. Exemplary tools include a Reservoir Description Tool (RDT™) by Halliburton Energy Services. The tool is able to collect, in a single deployment for example, formation pressure, fluid identification, and samples. A sealed probe is provided with the tool for isolating and extracting samples from the formation. Other tools and procedures may be provided for evaluation and collecting downhole samples.

BRIEF DESCRIPTION OF THE DRAWINGS

Implementations of the present technology will now be described, by way of example only, with reference to the attached figures, wherein.

DETAILED DESCRIPTION

Figure 1A:
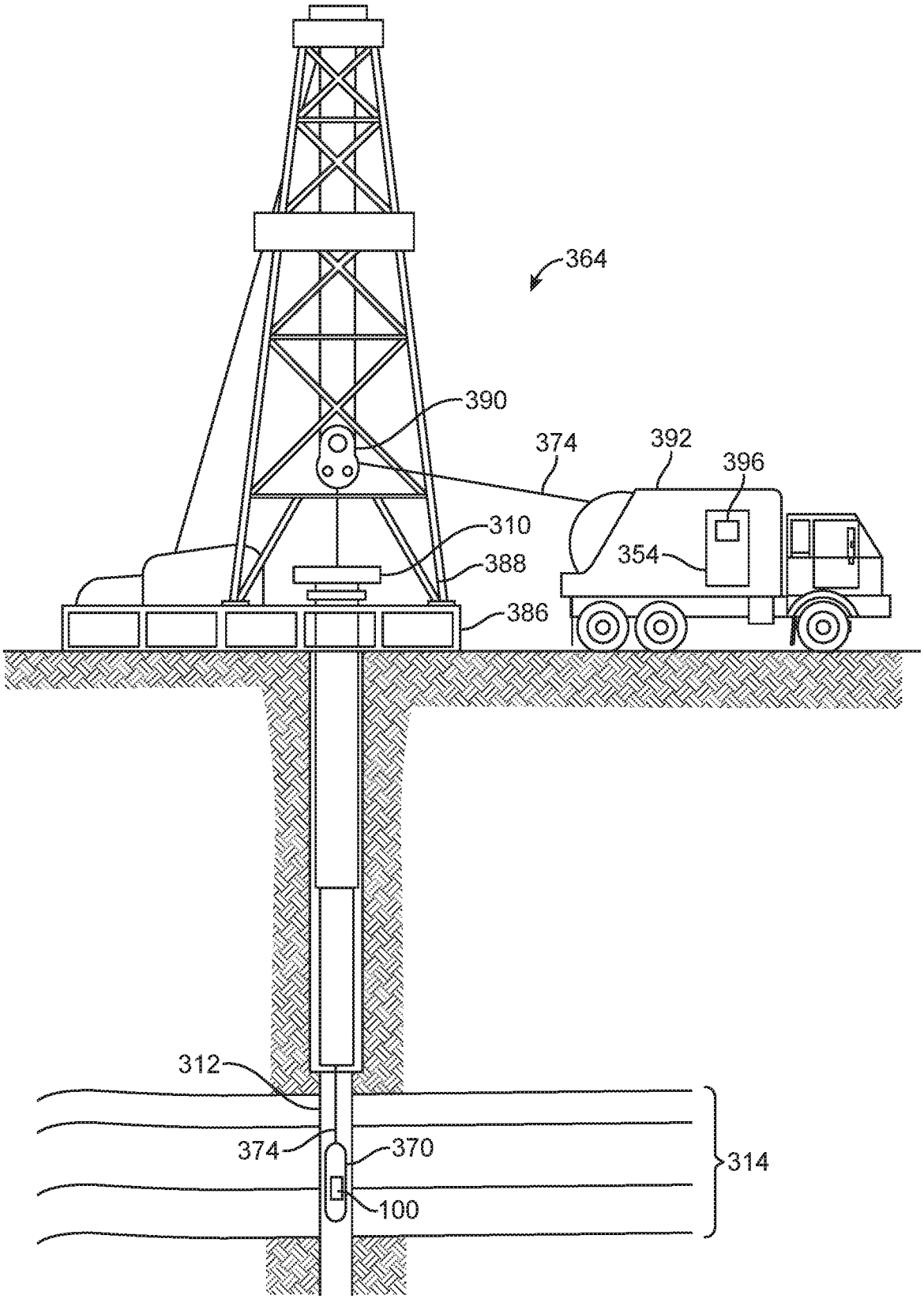
FIG. 1A is a diagram illustrating an exemplary environment for a filtration device according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

In the above description, reference to up or down is made for purposes of description with "up," "upper," "upward," "uphole," or "upstream" meaning toward the surface of the wellbore and with "down," "lower," "downward," "downhole," or "downstream" meaning toward the terminal end of the well, regardless of the wellbore orientation. Correspondingly, the transverse, axial, lateral, longitudinal, radial, etc., orientations shall mean orientations relative to the orientation of the wellbore or tool. The term "axially" means substantially along a direction of the axis of the object. If not specified, the term axially is such that it refers to the longer axis of the object.

Several definitions that apply throughout the above disclosure will now be presented. The term "coupled" is defined as connected, whether directly or indirectly through intervening components, and is not necessarily limited to physical connections. The connection can be such that the objects are permanently connected or releasably connected. The term "outside" or "outer" refers to a region that is beyond the outermost confines of a physical object. The term "inside" or "inner" refers to a region that is within the outermost confines of a physical object. The term "substantially" is defined to be essentially conforming to the particular dimension, shape or other word that substantially modifies, such that the component need not be exact. For example, "substantially cylindrical" means that the object resembles a cylinder, but can have one or more deviations from a true cylinder. The terms "comprising," "including" and "having" are used interchangeably in this disclosure. The terms "comprising," "including" and "having" mean to include, but not necessarily be limited to the things so described. The term "fines" means particulates, particles, or small formation or reservoir material. The terms fines and particles may be used interchangeably herein.

Disclosed herein is a filtration device to be used in a downhole tool in a wellbore. When extracting fluid from a formation or within the wellbore, various fine particulates, or "fines" tend to be present in the fluid. The filtration device disclosed herein may be employed to remove the fines to obtain a cleaner fluid for testing, or to test the fines themselves. The filtration device includes an entry valve, a bypass valve, a purge valve, and an exit valve. The filtration device also includes a series of filters which have inline valves on either side of the filters. The filters can each have gradually smaller pores to catch smaller fines. As a filter becomes clogged, the inline valves can open such that the fluid bypasses the clogged filter and proceeds to the next filter in line. For example, as the pressure differential across the inline valve increases past a predetermined amount due to a clogged filter, the inline valve can open to allow the fluid to bypass that filter and proceed to the next filter in line.

Further, as the filters need cleaning, the filters can be reverse purged. During reverse purging, all of the valves are closed. The bypass valve and the purge valve are opened. To reverse purge each filter, the corresponding inline valves are opened such that fluid flows through the bypass valve, across an inline valve, through the filter, across the opposite inline valve, and out the purge valve to the wellbore. The process of reverse purging can occur with each individual filter as desired.

The filtration device may also have an entry sensor and an exit sensor. The entry sensor and exit sensor can be, for example, optical sensors or pressure sensors. The entry sensor and exit sensor can determine whether the fluid is clean or filtered to a desired level. Further, the entry sensor and exit sensor can determine whether the filters are plugged and need cleaning or replacement. For example, if the pressure differential between the entry sensor and the exit sensor is equal to or greater than a predetermined amount, the filters can be replaced or reverse purged. Further, if the exit sensor determines that the fluid is not clean or sufficiently filtered, the fluid can be routed back through the filtration device for one or more additional rounds of filtering.

The filtration device can be employed in an exemplary wellbore system 364 shown, for example, in FIG. 1A. FIG. 1A shows a well during wireline logging operations. A drilling platform 386 is equipped with a derrick 388 that supports a hoist 390.

Drilling oil and gas wells is commonly carried out using a string of drill pipes connected together so as to form a drilling string that is lowered through a rotary table 310 into a wellbore or borehole 312. Here it is assumed that the drill string has been temporarily removed from the borehole 312 to allow a downhole tool 370, such as a probe or sonde, to be lowered by conveyance 374 into the borehole 312. A conveyance 374 can be, for example, tubing-conveyed, wireline, slickline, work string, coiled tubing, or any other suitable means for conveying downhole tools into a wellbore. Typically, the downhole tool 370 is lowered to the bottom of the region of interest and subsequently pulled upward at a substantially constant speed.

During, the upward trip, at a series of depths the tool movement can be paused and the tool set to pump fluids into the instruments included in the downhole tool 370 can be used to perform measurements on the subsurface geological formations 314 adjacent the borehole 312 (and the tool body 370). The measurement data can be communicated to a surface logging facility 392 for storage, processing, and analysis. The logging facility 392 may be provided with electronic equipment for various types of signal processing, which may be implemented by any one or more of the components of the downhole tool 370. Similar formation evaluation data may be gathered and analyzed during drilling operations (for example, during logging while drilling (LWD) operations, and by extension, sampling while drilling).

The downhole tool 370 includes a filtration device 100 to filter the fluids of obstructions or fines such that accurate measurements of the fluids can be obtained. The downhole tool 370 can also include a formation testing tool for obtaining and analyzing a fluid sample from a subterranean formation through a wellbore. The formation testing tool can be, for example, a HALLIBURTON® RDT™. The formation testing tool is suspended in the wellbore by a conveyance 374 that connects the tool to a surface control unit. The formation testing tool may be deployed in the wellbore on coiled tubing, jointed drill pipe, hard wired drill pipe, or any other suitable deployment technique.

The formation testing tool can include a body having a control module, a fluid acquisition module, and fluid storage modules. The body can be any suitable shape, for example cylindrical. The fluid acquisition module can include an extendable fluid admitting probe and extendable tool anchors. Fluid is drawn into the downhole tool 370 through one or more probes by a fluid pumping unit. The acquired fluid then flows through one or more fluid measurement modules so that the fluid can be analyzed using the techniques described herein. Resulting data can be sent to the workstation 354 via the conveyance 374. The fluid that has been sampled can be stored in the fluid storage modules and retrieved at the surface for further analysis.

Figure 1B:
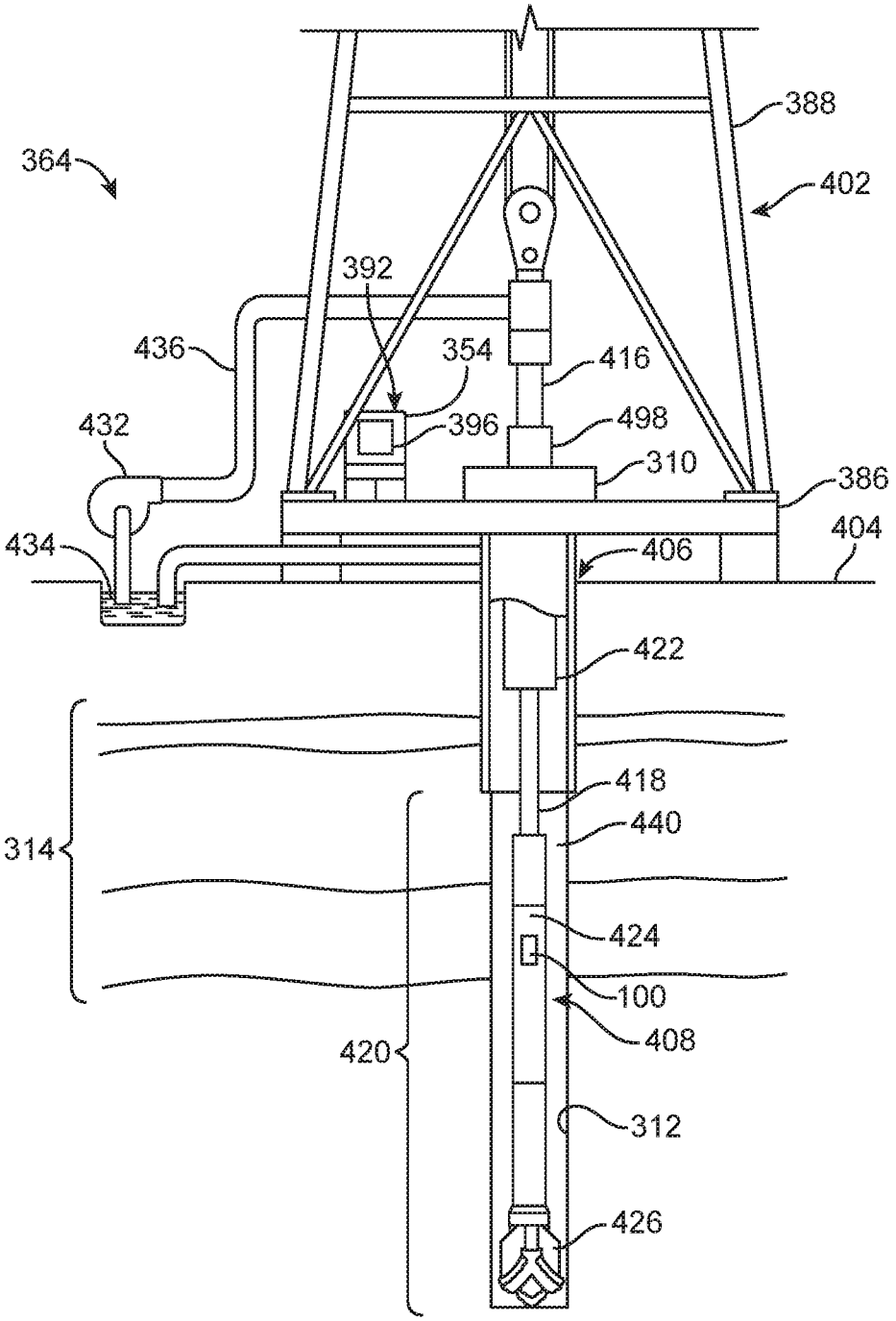
FIG. 1B is a diagram illustrating another exemplary environment for a filtration device according to the present disclosure.

The filtration device can also be employed in an exemplary wellbore system 364 shown, for example, in FIG. 1B. A system 364 can form a portion of a drilling rig 402 located at the surface 404 of a well 406. The drilling rig 402 provides support for a drill string 408. The drill string 408 can operate to penetrate a rotary table 310 for drilling a borehole 312 through subsurface formations 314. The drill string 408 can include a Kelly 416, drill pipe 418, and a bottom hole assembly 420, perhaps located at the lower portion of the drill pipe 418.

The bottom hole assembly 420 includes drill collars 422, a downhole tool 424, and a drill bit 426. The drill bit 426 creates a borehole 312 by penetrating the surface 404 and subsurface formations 314. The downhole tool 424 includes a filtration device 100. The filtration device 100 can be used for a variety of purposes including, but not limited to, protecting the pump from being plugged, assisting in the analysis of fluid, or for collection of fines for analysis of the wellbore. The downhole tool 424 can also include any of a number of different types of tools including MWD (measurement while drilling) tools, LWD tools, and others.

During drilling operations, the drill string 408 (which can including the Kelly 416, the drill pipe 418, and the bottom hole assembly 420) can be rotated by the rotary table 310. In addition to, or alternatively, the bottom hole assembly 420 can also be rotated by a motor (for example, a mud motor) that is located downhole. The drill collars 422 can be used to add weight to the drill bit 426. The drill collars 422 can also stiffen the bottom hole assembly 420, allowing the bottom hole assembly 420 to transfer the added weight to the drill bit 426, and in turn, assist the drill bit 426 in penetrating the surface 404 and subsurface formations 314.

During drilling operations, a mud pump 432 pumps drilling fluid (sometimes known by those of skill in the art as "drilling mud") from a mud pit 434 through a hose 436 into the drill pipe 418 and down to the drill bit 426. The drilling fluid can flow out from the drill bit 426 and be returned to the surface 404 through an annular area 440 between the drill pipe 418 and the sides of the borehole 312. The drilling fluid can then be returned to the mud pit 434, where such fluid is filtered. The drilling fluid may be used to cool the drill bit 426, as well as to provide lubrication for the drill bit 426 during drilling operations. Additionally, the drilling fluid may be used to remove subsurface formation 314 cuttings created by operating the drill bit 426.

It should be noted that while FIGS. 1A and 1B generally depict a land-based operation, those skilled in the art would readily recognize that the principles described herein are equally applicable to operations that employ floating or sea-based platforms and rigs, without departing from the scope of the disclosure. Also, even though FIGS. 1A and 1B depict a vertical wellbore, the present disclosure is equally well-suited for use in wellbores having other orientations, including horizontal wellbores, slanted wellbores, multilateral wellbores or the like. Further, the wellbore system 364 can have a casing already implemented while, in other examples, the wellbore system 364 can be used in open hole applications.

Figure 2:
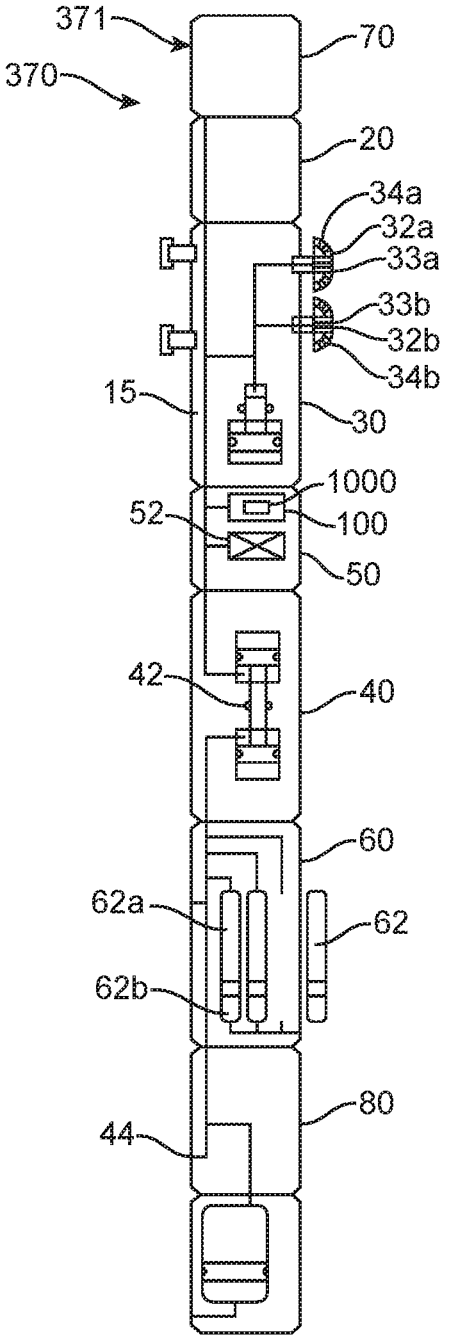
FIG. 2 is a diagram illustrating an exemplary tool incorporating a filtration device.

An exemplary downhole tool 370 which utilizes the filtration device 100 is shown in FIG. 2. While the disclosure is focused on the exemplary downhole tool 370 as shown in 2, the filtration device 100 and other features of the downhole tool 370 can be implemented in other types of tools.

The downhole tool 370 as shown in FIG. 2 is a modular downhole formation testing tool, which can be a HALLIBURTON® RDT™. The downhole tool 370 is made suitable for testing, retrieval and sampling along sections of the formation by means of contact with the surface of a borehole 312. The downhole tool 370 includes several modules (sections of the downhole tool 370) capable of performing various functions. As shown in FIG. 2, the downhole tool 370 has a body 371. The body 371 can be tubular and elongated, cylindrical, rectangular, or any suitable shape. The downhole tool 370 includes a hydraulic power module 20 that converts electrical into hydraulic power; a probe module 30 to take samples of the formation fluids; a flow control module 40 regulating the flow of various fluids in and out of the tool; a fluid test module 50 for performing different tests on a fluid sample; a multi-chamber sample collection module 60 that may contain various size chambers for storage of the collected fluid samples; a telemetry module 70 that provides electrical and data communication between the modules and a workstation 354 (shown in FIG. 1A), and possibly other sections designated in FIG. 2 collectively as 80. The arrangement of the various modules may depend on the specific application. The order or arrangement of the modules is not restricted to the arrangement as illustrated in FIG. 2.

The power telemetry section 70 conditions power for the remaining tool sections. Each section can have its own process-control system and can function independently. While section 70 provides a common intra-tool power bus, the entire tool string (extensions beyond downhole tool 370 not shown) shares a common communication bus that is compatible with other logging tools. This arrangement enables the tool to be combined with other logging systems, such as a Magnetic Resonance Image Logging (MRIL) or High-Resolution Array Induction (HRAI) logging systems.

The downhole tool 370 can be conveyed in the borehole by wireline (shown in FIG. 1A), which contains conductors for carrying power to the various components of the tool and conductors or cables (for example, coaxial or fiber optic cables) for providing two-way data communication between downhole tool 370 and a workstation 354 (shown in FIG. 1A). The downhole tool 370 may be conveyed by tubing-conveyed, slickline, work string, coiled tubing, or any other suitable means for conveying downhole tools 370 into a wellbore 312. The workstation 354 includes a computer and associated memory for storing programs and data. The workstation 354 generally controls the operation of downhole tool 370 and processes data received from it during operations. The workstation 354 can have a variety of associated peripherals, such as a recorder for recording data, a display for displaying desired information, printers and others. The telemetry module 70 may provide both electrical and data communication between the modules and the uphole control unit. Telemetry module 70 provides high-speed data bus from the workstation 354 to the modules to download sensor readings and upload control instructions initiating or ending various test cycles and adjusting different parameters, such as the rates at which various pumps are operating.

Flow control module 40 of the downhole tool 370 includes a pump 42. The pump 42 can be a double piston pump or any suitable pump to withdraw fluid from external the body 371. The pump 42 is in fluid communication with probes 32*a*, 32*b* and controls the formation fluid flow from the formation into flow line 15 via probes 32*a*, 32*b*. The probes 32*a*, 32*b* include intake ports 33*a*, 33*b* for receiving fluid from external the body 371. The probes 32*a*, 32*b* also include sealing pads 34*a*, 34*b* for engagement with a formation surface. The pump operation is generally monitored by the uphole workstation 354. Fluid entering the probes 32*a*, 32*b* flows through the intake ports 33*a*, 33*b* into the flow line 15 and can be discharged into the wellbore 312 via exit port 44. A fluid control device, such as a control valve, can be connected to flow line 15 for controlling the fluid flow from the flow line 15 into the borehole 312. Flow line fluids can be pumped either up or down with all of the flow line fluid directed into or though pump 42. Flow control module 40 can further accommodate strain-gauge pressure transducers that measure an inlet and outlet pump pressures.

The fluid testing section 50 of the tool contains a fluid testing device 52, which analyzes the fluid flowing through flow line 15. The fluid testing device 52 can be a device for optical analysis. For example, the fluid testing device 52 includes optical sensors. In other examples, the fluid sensors 52 can be analyte specific broadband filters, for example HALLIBURTON® ICE CORE sensors.

Any suitable device or devices can be utilized to analyze the fluid. Devices may be employed which include a number of sensors or quartz gauges. For example, in such gauge carriers the pressure resonator, temperature compensation, and reference crystal are packaged as a single unit. The assembly is contained in an oil bath that is hydraulically coupled with the pressure being measured. The quartz gauge enables measurement of such parameters as the drawdown pressure of fluid being withdrawn, fluid mobility and fluid temperature. Moreover, if two fluid testing devices 52 are run in tandem, the pressure difference between them can be used to determine fluid viscosity during pumping or density when flow is stopped.

A sample collection module 60 of the downhole tool 370 can contain various size chambers for storage of the collected fluid sample. Chamber section 60 contains at least one collection chamber, and can have a piston that divides chamber 62 into a top chamber 62*a* and a bottom chamber 62*b*. A conduit is coupled to bottom chamber 62*b* to provide fluid communication between bottom chamber 62*b* and the outside environment such as the wellbore 312. A fluid flow control device, such as an electrically controlled valve, can be placed in the conduit to selectively open the conduit to allow fluid communication between the bottom chamber 62*b* and the wellbore 312. Similarly, chamber section 62 can also contain a fluid flow control device, such as an electrically operated control valve, which is selectively opened and closed to direct the formation fluid from the flow line 15 into the upper chamber 62*a*.

The downhole tool 370 can also include a filtration device 100. As shown in FIG. 2, the filtration device 100 is contained within the body 371 in the fluid testing section 50 and is in fluid communication with the intake ports 32*a*, 32*b*. The filtration device 100 includes a particulate removing filter 1000 and filters fines and other particulates from the fluid. As such, the fines do not scatter or interfere with the analysis by the fluid testing device 52. For example, optical sensors can be affected in quality due to scattering. Solid particles, such as fines, can make optical results difficult to calculate due to both instabilities in the light throughput and low light levels. Further, even when results may be calculated with lower confidence, results can be difficult to interpret. The filtration device 100 filters out fines to an acceptable concentration such that the quality of the results from the optical sensors is desirable. The exit port 44 is in fluid communication with the filtration device 100 and ejects the fluid to external the body 371.

While the disclosure focuses on the filtration device 100 being utilized in conjunction with the fluid testing section 50, the filtration device 100 can be utilized at any section in the downhole tool 370. For example, the filtration device 100 can be located at the sample collection module 60. The filtration device 100 can collect and store the fines and other particulates that are filtered out to bring uphole for analysis. In another example, the filtration device 100 can be located prior to the flow control module 40 to protect the pump 42 from being clogged with fines and potentially malfunction.

Figure 3:
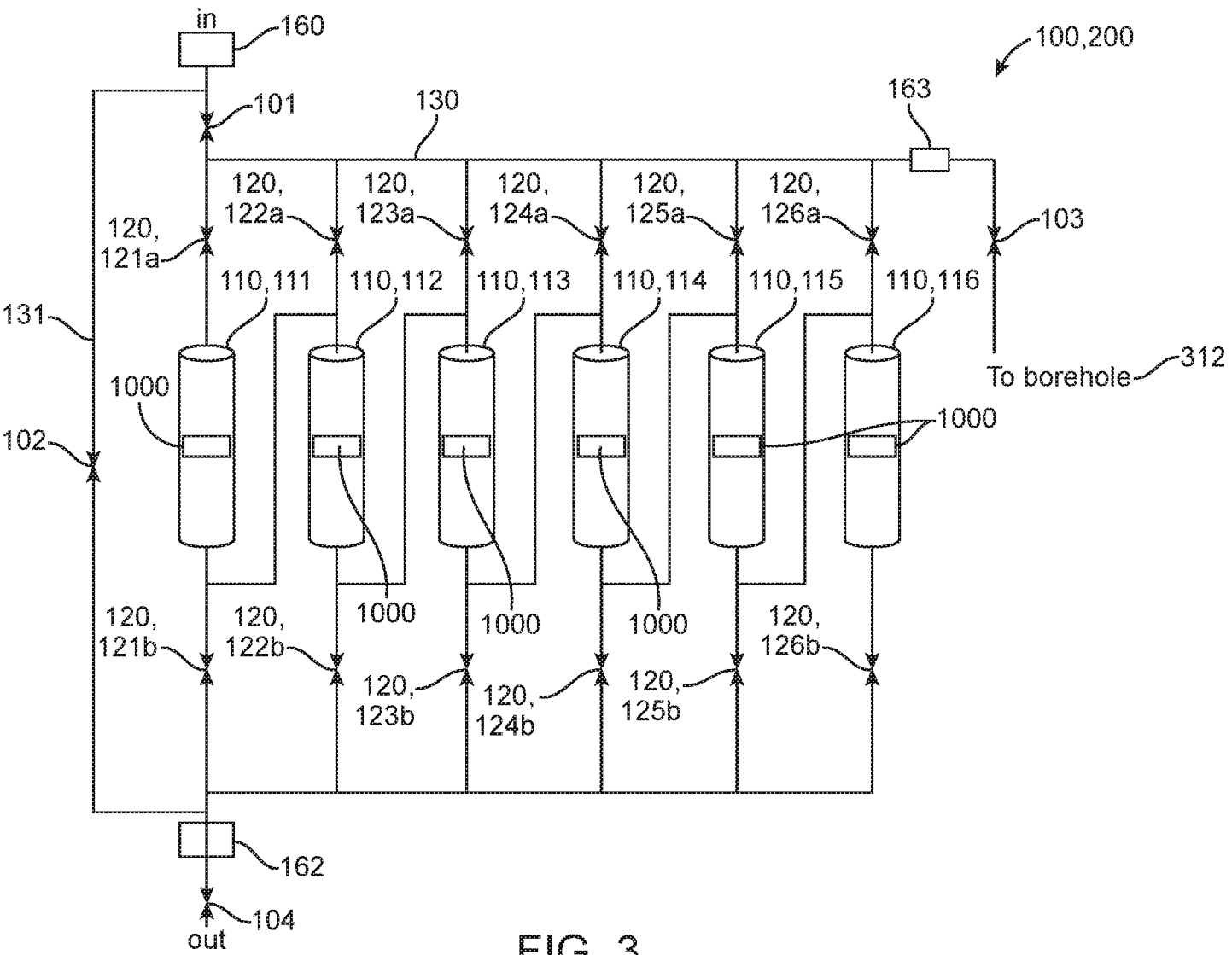
FIG. 3 is a diagram illustrating an embodiment of an exemplary filtration device.

FIG. 3 illustrates an exemplary filtration device with filter cartridge 110. Although in the illustrated example they are shown as filter cartridges, other suitable filter devices may be employed such as a belt or a cone screen. Each filter cartridge 110 (the plurality of filter cartridges 110 are designed herein as filter cartridges 111, 112, 113, 114, 115, 116) has at least one particulate removing filter 1000 each with a different particulate filtration size. As shown in FIG. 3, the filtration device 100 begins with filter 111 having a particulate removing filter 1000 with the largest pore size. Each filter cartridge having a particulate removing filter 1000 with a progressively smaller pore size until the last filter cartridge 116 having a particulate removing filter 1000 with the smallest pore size. In other words, filter 111 has the particulate removing filter 1000 with the coarsest filtration size and filter 116 has the particulate removing filter 1000 with the finest filtration size. The first filter cartridge 111 captures the largest fines, and subsequent filters captures smaller fines. The last filter cartridge 116 captures the smallest fines. Filter cartridges 112, 113, 114, and 115 have different degrees of pore size progressing from largest pore size for filter cartridge 112 and smallest pore size for filter cartridge 115. Alternatively, or additionally, the filter cartridges each have individual filters with different pore sizes. Filter cartridges 110 can be selected according to a typical size distribution of fines, or particles, for a drilling fluid, for example mud. The filter cartridges 110 are separated by gaps. The size of the gaps can be determined according to the relative volume of fines per size in a total volume of fluid.

The filtration device 100 has an entry valve 101 which permits flow of fluid from the tool to the filtration device 100 for filtration. The filtration device 100 also has an exit valve 104 which permits flow of fluid out of the filtration device 100. Each filter cartridge 110 is inserted in a flow line 130 between two inline valves 120. The inline valves 120 (the plurality of inline valves 120 designated here as 122*a*, 123*a*, 124*a*, 125*a*, 126*a*) can be check valves such that if the pressure drop across the inline valves 120 exceeds a predetermined amount, for example 20 psi, the inline valve 120 is opened such that the filter cartridge 110 is bypassed. As shown in FIG. 3, filter cartridge 111 has an inline valve 121*a* coupled to the flow line 130 on a first side of the filter cartridge 111 and an inline 121*b* coupled to a second side of the filter cartridge 111 opposite the first side. Filter cartridge 112 is inserted between inline valve 122*a* and inline valve 122*b*; filter cartridge 113 is inserted between inline valve 123*a* and inline valve 123*b*; filter cartridge 114 is inserted between inline valve 124*a* and inline valve 124*b*; filter cartridge 115 is inserted between inline valve 125*a* and inline valve 125*b*; and filter cartridge 116 is inserted between inline valve 126*a* and inline valve 126*b*. The filter cartridges 110 are also connected by fluid lines 132. Further, the filtration device 100 includes a purge valve 103 which opens up the flow line 130 to the borehole 312.

When the filtration device 100 is filtering, all of the inline valves 120 and the purge valve 103 are closed. Entry valve 101, inline valve 121*a*, and inline valve 126*b* are opened. The fluid flows through the entry valve 101 and inline valve 121*a* to the filters 120. The fluid first flows across filter 111, passes through fluid line 132, flows across filter cartridge 112, and continues through the remaining filter cartridges 110. After passing across filter cartridge 116, the fluid flows through valve 126*b* and, if the fluid is adequately filtered, out of the filtration device 100 through exit valve 104. If the fluid is not adequately filtered, the bypass valve 102 closes, and the fluid can pass through the bypass line 131 and re-enter the filtration device 100 through entry valve 101 for another round of filtering.

Further, the filtration device 100 can have a bypass line 131 which includes a bypass valve 102. If one of the filter cartridges 110 becomes backed up or clogged, the pressure differential across the corresponding inline valve 120 increases. The inline valve 120 then opens such that the filter cartridge 110 is bypassed, and the fluid flows to the next filter cartridge 110. For example, if filter cartridge 112 is clogged, the pressure differential across inline valve 122*a* would increase. When the pressure differential becomes greater than a predetermined value, for example 20 psi, the inline valve 122*a* would open. The fluid then does not pass across filter cartridge 112; instead, inline valve 123*a* opens, and the fluid passes through the flow line 130, to the subsequent filter cartridge 113. If filter cartridge 113 is also clogged, then the next available filter cartridge 110 will be used. As such, the filtration device 100 does not plug.

The filters 110 can be cleaned or regenerated such that the fines that are trapped by the filter cartridges 110 are cleared out. A method of cleaning out the filter cartridges 110 is by reverse purging. As shown in FIG. 3, the bypass line 131 is utilized in reverse purging. The bypass line 131 can be concentric with the filter cartridges 110, and can be used to reverse direction of the flow through the filter mechanism in part or in whole. The bypass line 131 can be opened to reverse the direction of fluid around the entire assembly and through the last filter cartridge 110, 116. Further, the bypass line 131 can be opened, along with exit valve 104, to allow fluid to flow across the tool 100 without flowing through filter cartridges 110.

The bypass line 131 can be operated electrically. Additionally, or alternatively, the bypass line 131 can be manually opened to reverse flow, or automatically as a function of the last filter cartridge 110, 116 moving to a bypass direction. When the bypass line 131 is opened to reverse the flow through the back side of the filter cartridges 110, the fluid cleans the particles out of the filter cartridge 110 and directs the particles to the wellbore 312 through the purge valve 103. When the filter cartridges 110 are sufficiently cleaned, the pressure drops across the inline valves 120, activating the next filter cartridge 110 in series to receive the reverse fluid flow until the entire assembly is cleaned, sequentially. The last filter cartridge 110 being cleaned resets the flow back to the normal direction.

The sensing action to determine the opening of the inline valves 120 can be mechanical, electrical, or optical using a reverse purge sensor 163 that measures optical density at the purge valve 103. Rather than sensing the pressure drop across the inline valves 120 when reverse purging, the cleaning sequence may be timed or manually controlled.

Each of the filter cartridges 110 may be individually connected to a valve that purges fluid or particles to the wellbore 312.

As illustrated in FIG. 3, to begin reverse purging, all of the valves may begin in a closed state. Bypass valve 102 and purge valve 103 are then opened. Reverse purging each filter cartridge 110 is accomplished by opening the respective inline valves 120 for that filter cartridge 110. For example, to reverse purge filter cartridge 111, inline valves 121*a*, 121*b* are opened. Fluid flows through the bypass line 131, across the bypass valve 102, and across inline valve 121*b* to the backside of filter cartridge 111. The fluid, with the fines inside the filter cartridge 111, across inline valve 121*a*, through fluid line 130, and across purge valve 103 to the wellbore 312. As such, the filter cartridge 111 is cleaned and cleared out. Then, inline valves 121*a*, 121*b* can be closed, and inline valves 122*a*, 122*b* are opened to reverse purge filter cartridge 112. The process can continue until the desired filter cartridges 110 are reverse purged.

Alternatively, or additionally, the inline valves 120 have three states. The inline valve 120 can pass the fluid through the filter cartridge 110 to the flow line 130 as a bypass for downstream filters 110; the inline valve 120 can bypass the filter cartridge 110 directly to the flow line 130; or the inline valve 120 can bypass the filter cartridge 110 and pass the fluid to the next filter cartridge 110. As discussed above, the filter cartridges 110 can be regenerated by reversing flow through the entire series and out through a purge valve 103 to the wellbore 312. Switching from a filter cartridge 110 to the next in line filter cartridge 110 can be an automatic process such that when the pressure drop across the filter cartridge 110 is greater than a predetermined value, for example 20 psi, a loaded spring opens as a check valve to the next filter cartridge 110. The process can also be a manual process.

Further, between each inline valve 120, and in front of the first inline valve 120, a toggle valve may be provided to direct flow to either a bypass or the next filter cartridge 110. The toggle valve can be controlled electrically, automatically, or manually. In automatic mode, if a sensor were to detect the absence of particles, then the toggle valve would bypass all of the filter cartridges 110, for example by passing the fluid through the bypass line 131. The toggle valve can be, for example, a 6 port valve, an electronic three way filter valve, or any suitable valve.

To determine whether the fluid is sufficiently filtered, the filtration device 100 may include an entry sensor 160 at the beginning of the filtration device 100 and an exit sensor 162 at the end of the filtration device 100. The entry sensor 160 and the exit sensor 162 can be any suitable sensor to analyze the fluid. For example, the entry sensor 160 and the exit sensor 162 can be at least one of optical sensors, pressure sensors, vibrating tube densitometers, or capacitance sensors. The entry sensor 160 and the exit sensor 162 can communicate with the valves, for example the entry valve 101, the bypass valve 102, the purge valve 103, and the exit valve 104. For example, if the entry sensor 160 senses that the fluid coming into the filtration device 100 is sufficiently clean, the bypass valve 102 and the exit valve 104 can open and the fluid bypasses the filter cartridges 110. If the exit sensor 162 senses that the fluid is not yet sufficiently filtered, the exit valve 104 can remain closed, and the bypass valve 102 can be opened such that the fluid flows back through the filter cartridges 110. Further, if a large pressure differential pressure is sensed between entry valve 160 and exit valve 162, the filter cartridges 110 may be clogged; and the filter cartridges 110 can be reverse purged or replaced.

Figure 4:
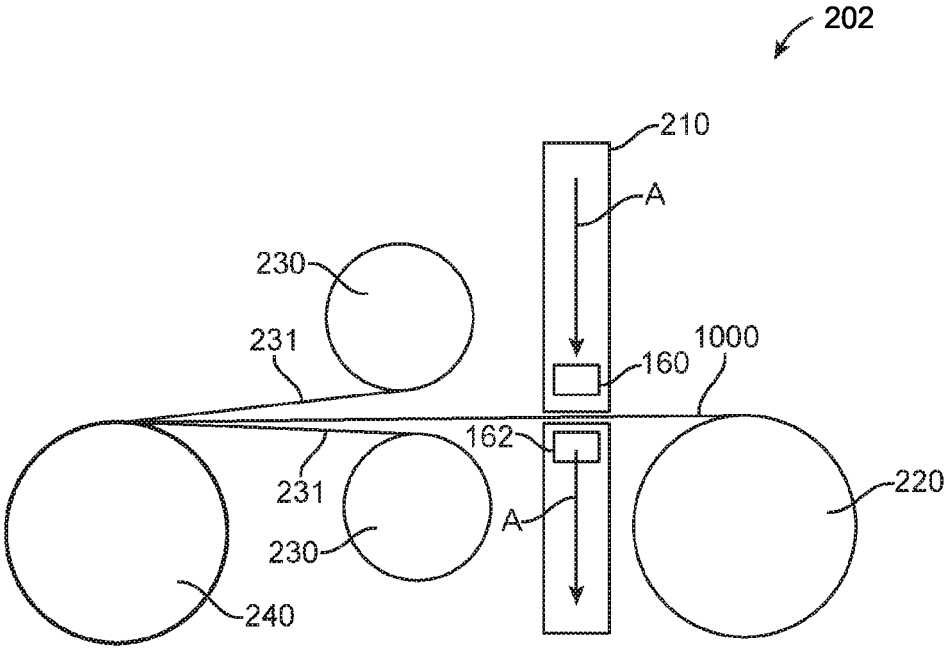
FIG. 4 is a diagram illustrating another embodiment of an exemplary filtration device.

If desired, the fines can be saved and provide analysis of the wellbore. The filter cartridges 110, as filter cartridges shown in FIG. 3, can be replaced and saved. As shown in FIG. 4, the filter particulate removing filter 1000 can be laminated with film 231 into a laminated sample 240 to be analyzed at the surface.

FIG. 4 illustrates a roll assembly 202 where particulate removing filter 1000 that can be stored for analysis. The particulate removing filter 1000 is a belt, such that the particulate removing filter 1000 can be driven to reveal and utilize a new section of the particulate removing filter 1000. The roll assembly 202, as shown in FIG. 4, can be utilized in any suitable filtration device 100. If multiple filters are desired, the roll assembly 202 can have multiple filters 221 aligned in a series.

In the roll assembly 202 of FIG. 4, the fluid 210 flows in the direction A. The fluid 210 flows across particulate removing filter 1000. The particulate removing filter 1000 can be, for example, a screen or a mesh. The particulate removing filter 1000 can be a metallic screen, such as a Dutch Weave Twill screen. The particulate removing filter 1000 is contained in filter roll 220. The filter roll 220 contains the particulate removing filter 1000 which is released or drawn out of the filter roll 220 when the fines have plugged the current section of particulate removing filter 1000. The filter roll 220 can be a roll or spool of particulate removing filter 1000.

The roll assembly 202 can also have an entry sensor 160 and an exit sensor 162. The entry sensor 160 and the exit sensor 162 are on opposite sides of the particulate removing filter 1000 along the flow line of fluid 210. The entry sensor 160 and the exit sensor 162 can be any suitable sensor to analyze the fluid. For example, the entry sensor 160 and the exit sensor 162 can be at least one of optical sensors, pressure sensors, vibrating tube densitometers, or capacitance sensors. If the pressure differential between the entry sensor 160 and the exit 162 sensor is equal to or greater than a predetermined amount, the particulate removing filter 1000 may be plugged. If so, the used section of the particulate removing filter 1000 is moved out of the fluid 210, and the filter roll 220 provides new particulate removing filter 1000.

The section of the particulate removing filter 1000 with fines is shifted to be laminated. On either side of the particulate removing filter 1000 are spools 230 of laminate 231 (which may be a plastic or composite). The laminate 231 seal the particulate removing filter 1000 as the particulate removing filter 1000 is shifted towards the laminated sample 240. The laminated sample 240 then stores the particulate removing filter 1000 with the fines for later analysis. The particulate removing filter 1000 with the fines can be preserved to allow the later determination of features and properties, such as origin, mud, wear products, formation minerals, and clay. The time and length of the particulate removing filter 1000 being exposed to the fluid and fines provides a history of particulate production which can be a pre-production test to determine sanding of the formation. The information can aid in the design and deployment of production stings as well as to inform of the suitability of the kit that is needed, for example barefoot liners, slotted liners, screens, or gravel packed screens.

Figure 5:
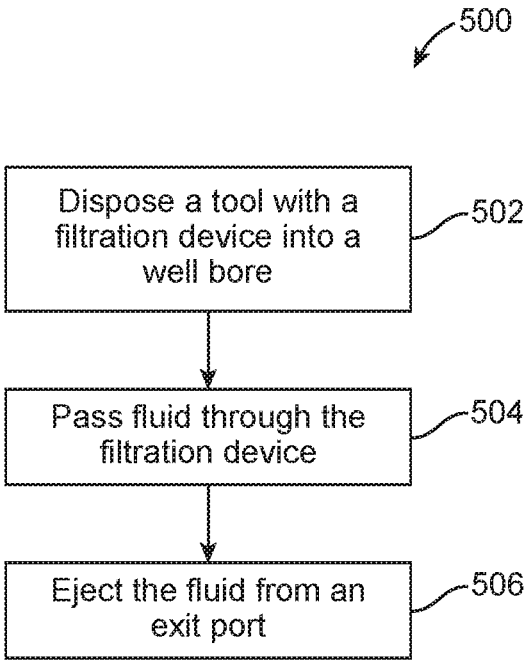
FIG. 5 is a flow chart of a method for utilizing an exemplary filtration device.

Referring to FIG. 5, a flowchart is presented in accordance with an example embodiment. The method 500 is provided by way of example, as there are a variety of ways to carry out the method. The method 500 described below can be carried out using the configurations illustrated in FIGS. 1A-4, for example, and various elements of these figures are referenced in explaining example method 500. Each block shown in FIG. 5 represents one or more processes, methods or subroutines, carried out in the example method 500. Furthermore, the illustrated order of blocks is illustrative only and the order of the blocks can change according to the present disclosure. Additional blocks may be added or fewer blocks may be utilized, without departing from this disclosure. The example method 500 can begin at block 502.

At block 502, a downhole tool is disposed into a wellbore. The downhole tool includes a body, an intake port provided along the body, a filtration device, and an exit port. The body can be cylindrical or any other suitable shape. The intake port receives fluid from external the body and is in fluid communication with the filtration device. The filtration device is contained within the body and has a particulate removing filter. The filtration device may include multiple filter cartridges, each with different particulate removing filters having different particulate filtration sizes. Also, the filter cartridges can be arranged in series. For example, a first filter cartridge can have a particulate removing filter with the coarsest particulate filtration size and the final filter cartridge can have the finest filtration size. Each filter cartridge can have an inline valve at each end of the filter cartridge. The inline valves can be, for example, check valves such that when a pressure differential across the inline valve is equal to or greater than a predetermined amount, the inline valves open. The inline valves can also be manually or electronically opened.

The filtration device also includes a bypass line with a bypass valve. When the bypass valve is open, the fluid bypasses the filter cartridges. Further, the filtration device can include a purge valve which is arranged to expel fluid external the tool. The exit port is also in fluid communication with the filtration device and ejects the fluid to external the body.

The fluid, at block 504, is passed through the filtration device. The fluid can be extracted from a wellbore or a formation. One or more characteristics of the fluid passing to, within, or subsequent the filtration device can be detected with a sensor. The sensor can be selected from the group consisting of optical sensors, pressure sensors, vibrating tube densitometers, capacitance sensors, or a combination thereof. The concentration of the particulate can be detected after passing the fluid through the filtration device. After the concentration of the particulate is equal to or less than a predetermined amount, the fluid, at block 506, is ejected from the exit port.

If the filters are plugging or need cleaning, the filter cartridges in the filtration device can be regenerated via a reverse purge. During the reverse purge, all of the valves are closed. The bypass valve is opened such that the fluid flows through the bypass line. The inline valves for the filter cartridge to be reverse purged are open such that the fluid flows through the filter cartridge in a reverse direction, removing the fines that are plugging the filter cartridge. The purge valve is also opened such that the fluid with the purged fines is ejected external the tool through the exit port. After adequate purging, the inline valves are closed, and another set of inline valves can be opened to reverse purge another filter. Characteristics of the fluid can be detected with a sensor to determine whether the filter cartridge is adequately cleaned.

Numerous examples are provided herein to enhance understanding of the present disclosure. A specific set of statements are provided as follows.

Statement 1: A downhole tool comprising: a body; an intake port for receiving fluid from external the body; a pump in fluid communication with the intake port for withdrawing fluid through the intake port; a filtration device having a particulate removing filter, a flow line extending from the intake port to the filtration device, the filtration device being contained within the body and in fluid communication with the intake port; and an exit port in fluid communication with the filtration device for ejecting fluid to external the body.

Statement 2: A downhole tool is disclosed according to Statement 1, further comprising a probe which comprises the intake port, the probe having a sealing pad for engagement with a formation surface.

Statement 3: A downhole tool is disclosed according to Statements 1-2, the filtration device comprising: a plurality of filter cartridges, each of the plurality of filter cartridges having different particulate filtration sizes; a fluid flow path extending across the plurality of filter cartridges from a first filter cartridge to a final filter cartridge; wherein the particulate filtration sizes of the plurality of filter cartridges progress from the first filter cartridge having the coarsest particulate filtration size to the final filter cartridge having the finest particulate filtration size.

Statement 4: A downhole tool is disclosed according to Statement 3, wherein the plurality of filter cartridges are arranged in series.

Statement 5: A downhole tool is disclosed according to Statement 4, wherein there is an inline valve for each filter cartridge in the series.

Statement 6: A downhole tool is disclosed according to Statements 3-5, wherein the filtration device comprises a bypass line to bypass the plurality of filter cartridges.

Statement 7: A downhole tool is disclosed according to Statements 1-6, further comprising a sensor positioned to detect a characteristic of a fluid passing to, within or after the filtration device.

Statement 8: A downhole tool is disclosed according to Statement 7, wherein the sensor is selected from the group consisting of optical sensors, pressure sensors, vibrating tube densitometers, capacitance sensors, or a combination thereof.

Statement 9: A downhole tool is disclosed according to Statements 7 or 8, wherein the sensor is an optical sensor, and wherein the filtration device is configured to remove fines to a predetermined concentration as detected by the optical sensor.

Statement 10: A downhole tool is disclosed according to Statements 1-8, wherein the filtration device is configured to bypass at least one of the plurality of filter cartridge to a secondary filter cartridge of the plurality of filter cartridges when a pressure differential across the first filter cartridge reaches a predetermined level.

Statement 11: A downhole tool is disclosed according to Statements 1-10, wherein the filtration device comprises a purge valve arranged to expel fluid from a reverse purge flow through the filtration device to a wellbore.

Statement 12: A downhole tool is disclosed according to Statements 1-11, wherein the filtration device comprises a roll assembly having a filter roll, wherein fluid from the intake port is passed through a particulate removing filter drawn from the filter roll.

Statement 13: A method comprising: disposing a downhole tool into a wellbore, the downhole tool comprising: a body, an intake port provided along the body, a filtration device having a particulate removing filter, the filtration device being contained within the body and in fluid communication with the intake port, an exit port in fluid communication with the filtration device for ejecting fluid to external the body; passing the fluid through the filtration device; and ejecting the fluid from the exit port.

Statement 14: A method is disclosed according to Statement 13, further comprising: detecting a characteristic of a fluid passing to, within or subsequent the filtration device with a sensor.

Statement 15: A method is disclosed according to Statement 14, wherein the sensor is selected from the group consisting of optical sensors, pressure sensors, vibrating tube densitometers, capacitance sensors, or a combination thereof.

Statement 16: A method is disclosed according to Statements 13-15, further comprising: detecting the concentration of the particulate after passing through the filtration device.

Statement 17: A method is disclosed according to Statements 13-16, further comprising: regenerating the filtration device via a reverse purge.

Statement 18: A method is disclosed according to Statements 13-17, wherein the filtration device comprises a plurality of filter cartridges.

Statement 19: A method is disclosed according to Statement 18, wherein the plurality of filter cartridges are arranged in series.

Statement 20: A system comprising: a downhole tool disposed in a wellbore, the downhole tool comprising: a body; an intake port for receiving fluid from external the body; a pump in fluid communication with the intake port for withdrawing fluid through the intake port; a filtration device having a particulate removing filter, a flow line extending from the intake port to the filtration device, the filtration device being contained within the body and in fluid communication with the intake port; and an exit port in fluid communication with the filtration device for ejecting fluid to external the body.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A downhole tool comprising:

a body;

an intake port for receiving fluid from an exterior of the body;

a pumping action in fluid communication with the intake port for withdrawing the fluid through the intake port;

a filtration device contained within the body and in fluid communication with the intake port, the filtration device comprising:

a particulate removing filter configured to filter the fluid to a predetermined concentration;

an entry sensor configured to measure a first fluid property;

an exit sensor configured to measure a concentration of the fluid filtered by the particulate removing filter and further configured to measure a second fluid property, wherein the fluid filtered by the particulate removing filter is routed back to the particulate removing filter if a difference between the first fluid property and the second fluid property is greater than a predetermined value; and a filter assembly, wherein the fluid from the intake port is passed through the particulate removing filter drawn from the filter assembly and a portion of the particulate removing filter drawn from the filter assembly is laminated; and an exit port in fluid communication with the filtration device for ejecting the fluid to the exterior of the body, wherein the fluid is stored for subsequent analysis.

2. The downhole tool of claim 1, further comprising a probe which comprises the intake port, the probe having a sealing pad for engagement with a formation surface.

3. The downhole tool of claim 1, the filtration device comprising:

a plurality of filter cartridges, each of the plurality of filter cartridges having different particulate filtration sizes; and a fluid flow path extending across the plurality of filter cartridges from a first filter cartridge to a final filter cartridge;

wherein the particulate filtration sizes of the plurality of filter cartridges progress from the first filter cartridge having the coarsest particulate filtration size to the final filter cartridge having the finest particulate filtration size.

4. The downhole tool of claim 3, wherein the plurality of filter cartridges are arranged in series.

5. The downhole tool of claim 4, further comprising an inline valve for each of the plurality of filter cartridges arranged in series.

6. The downhole tool of claim 3, wherein the filtration device comprises a bypass line to bypass the plurality of filter cartridges.

7. The downhole tool of claim 1, wherein at least one of the entry sensor and the exit sensor is positioned to detect a characteristic of the fluid passing to, within or after the filtration device.

8. The downhole tool of claim 7, wherein at least one of the entry sensor and the exit sensor is selected from a group consisting of optical sensors, pressure sensors, vibrating tube densitometers, capacitance sensors, or a combination thereof.

9. The downhole tool of claim 7, wherein at least one of the entry sensor and the exit sensor is an optical sensor, and wherein the filtration device is configured to remove fines to a predetermined concentration as detected by the optical sensor.

10. The downhole tool of claim 1, wherein the filtration device is configured to bypass at least one of a plurality of filter cartridges to a secondary filter cartridge of the plurality of filter cartridges when a pressure differential across a first filter cartridge reaches a predetermined value.

11. The downhole tool of claim 1, wherein the filtration device comprises a purge valve arranged to expel the fluid from a reverse purge flow through the filtration device to a wellbore.

12. The downhole tool of claim 1, wherein the first fluid property is a first pressure and the second fluid property is a second pressure.

13. A method comprising:

disposing a downhole tool into a wellbore, the downhole tool comprising:

a body, an intake port provided along the body, a filtration device contained within the body and in fluid communication with the intake port, the filtration device comprising:

a particulate removing filter configured to filter fluid to a predetermined concentration;

an entry sensor configured to measure a first fluid property;

an exit sensor configured to measure a concentration of the fluid filtered by the particulate removing filter and further configured to measure a second fluid property, wherein the fluid filtered by the particulate removing filter is routed back to the particulate removing filter if a difference between the first fluid property and the second fluid property is greater than a predetermined value; and a filter assembly, wherein the fluid from the intake port is passed through the particulate removing filter drawn from the filter assembly and a portion of the particulate removing filter drawn from the filter assembly is laminated; and an exit port in fluid communication with the filtration device for ejecting the fluid to an exterior of the body;

passing the fluid through the filtration device; and ejecting the fluid from the exit port, wherein the ejected fluid is stored for subsequent analysis.

14. The method of claim 13, further comprising: detecting a characteristic of the fluid passing to, within or subsequent the filtration device with at least one of the entry sensor and the exit sensor.

15. The method of claim 14, wherein at least one of the entry sensor and the exit sensor is selected from a group consisting of optical sensors, pressure sensors, vibrating tube densitometers, capacitance sensors, or a combination thereof.

16. The method of claim 13, further comprising: detecting a concentration of the fluid after passing through the filtration device.

17. The method of claim 13, further comprising: regenerating the filtration device via a reverse purge.

18. The method of claim 13, wherein the filtration device comprises a plurality of filter cartridges.

19. The method of claim 18, wherein the plurality of filter cartridges are arranged in series.

20. A system comprising:

a downhole tool disposed in a wellbore, the downhole tool comprising:

a body;

an intake port for receiving fluid from an exterior of the body;

a pumping action in fluid communication with the intake port for withdrawing the fluid through the intake port;

a filtration device contained within the body and in fluid communication with the intake port, the filtration device comprising:

a particulate removing filter configured to filter the fluid to a predetermined concentration;

an entry sensor configured to measure a first fluid property;

an exit sensor configured to measure a concentration of the fluid filtered by the particulate removing filter and further configured to measure a second fluid property, wherein the fluid filtered by the particulate removing filter is routed back to the particulate removing filter if a difference between the first fluid property and the second fluid property is greater than a predetermined value; and a filter assembly, wherein the fluid from the intake port is passed through the particulate removing filter drawn from the filter assembly and a portion of the particulate removing filter drawn from the filter assembly is laminated; and an exit port in fluid communication with the filtration device for ejecting the fluid to the exterior of the body, wherein the fluid is stored for subsequent analysis.

* * * * *